US011551903B2

(12) United States Patent
Rommel

(10) Patent No.: US 11,551,903 B2
(45) Date of Patent: Jan. 10, 2023

(54) DEVICES AND METHODS FOR DISSIPATING HEAT FROM AN ANODE OF AN X-RAY TUBE ASSEMBLY

(71) Applicant: American Science and Engineering, Inc., Billerica, MA (US)

(72) Inventor: Martin Rommel, Lexington, MA (US)

(73) Assignee: American Science and Engineering, Inc., Billerica, MA (US)

( * ) Notice: Subject to any disclaimer, the term of this patent is extended or adjusted under 35 U.S.C. 154(b) by 0 days.

(21) Appl. No.: 17/355,308

(22) Filed: Jun. 23, 2021

(65) Prior Publication Data

US 2021/0407759 A1 Dec. 30, 2021

Related U.S. Application Data

(60) Provisional application No. 63/044,210, filed on Jun. 25, 2020.

(51) Int. Cl.

| | |
|---|---|
| ***H01J 35/12*** | (2006.01) |
| ***H01J 35/08*** | (2006.01) |
| ***H01J 35/18*** | (2006.01) |

(52) U.S. Cl.

CPC ..... *H01J 35/12* (2013.01); *H01J 35/116* (2019.05); *H01J 35/18* (2013.01); *H01J 2235/1204* (2013.01); *H01J 2235/1295* (2013.01); *H01J 2235/168* (2013.01)

(58) Field of Classification Search

CPC ..... H01J 35/12; H01J 2235/1204; H01J 2235/1295

See application file for complete search history.

(56) References Cited

U.S. PATENT DOCUMENTS

| | | | |
|---|---|---|---|
| 2,952,790 | A | 9/1960 | Steen |
| 3,239,706 | A | 3/1966 | Farrell |
| 3,768,645 | A | 10/1973 | Conway |
| 4,057,725 | A | 11/1977 | Wagner |
| 4,105,922 | A | 8/1978 | Lambert |
| 4,228,353 | A | 10/1980 | Johnson |
| 4,259,721 | A | 3/1981 | Kuznia |

(Continued)

FOREIGN PATENT DOCUMENTS

| | | |
|---|---|---|
| DE | 2729353 A1 | 1/1979 |
| EP | 0432568 | 6/1991 |

(Continued)

OTHER PUBLICATIONS

International Search Report for PCT/GB2004/001729, dated Aug. 12, 2004.

*Primary Examiner* — Chih-Cheng Kao
(74) *Attorney, Agent, or Firm* — Novel IP

(57) ABSTRACT

An X-ray tube with an anode assembly and specially designed heat transfer element is described. The anode assembly includes an X-ray producing target and a substantially cylindrical electrode that stops or inhibits electrons that may back-scatter from the target. At least one heat transfer element is positioned proximate the anode assembly and in the region between a conducting enclosure and a non-conducting hollow housing or tube. The heat transfer element is positioned to thermally couple the hot anode assembly to an air-cooled conducting enclosure while maintaining an electric isolation.

26 Claims, 4 Drawing Sheets

(56) References Cited

U.S. PATENT DOCUMENTS

| | | | |
|---|---|---|---|
| 4,266,425 | A | 5/1981 | Allport |
| 4,274,005 | A | 6/1981 | Yamamura |
| 4,340,816 | A | 7/1982 | Schott |
| 4,352,021 | A | 9/1982 | Boyd |
| 4,468,802 | A | 8/1984 | Friedel |
| 4,672,649 | A | 6/1987 | Rutt |
| 4,675,890 | A | 6/1987 | Plessis |
| RE32,961 | E | 6/1989 | Wagner |
| 4,866,745 | A | 9/1989 | Akai |
| 4,868,856 | A | 9/1989 | Frith |
| 4,887,604 | A | 12/1989 | Shefer |
| 5,033,106 | A | 7/1991 | Kita |
| 5,247,556 | A | 9/1993 | Eckert |
| 5,259,014 | A | 11/1993 | Brettschneider |
| 5,272,627 | A | 12/1993 | Maschhoff |
| 5,313,511 | A | 5/1994 | Annis |
| 5,367,552 | A | 11/1994 | Peschmann |
| 5,467,377 | A | 11/1995 | Dawson |
| 5,511,104 | A | 4/1996 | Mueller |
| 5,604,778 | A | 2/1997 | Polacin |
| 5,633,907 | A | 5/1997 | Gravelle |
| 5,689,541 | A | 11/1997 | Schardt |
| 5,841,831 | A | 11/1998 | Hell |
| 5,859,891 | A | 1/1999 | Hibbard |
| 5,966,422 | A | 10/1999 | Dafni |
| 5,974,111 | A | 10/1999 | Krug |
| 5,987,097 | A | 11/1999 | Salasoo |
| 6,018,562 | A | 1/2000 | Willson |
| 6,122,343 | A | 9/2000 | Pidcock |
| 6,181,765 | B1 | 1/2001 | Sribar |
| 6,183,139 | B1 | 2/2001 | Solomon |
| 6,218,943 | B1 | 4/2001 | Ellenbogen |
| 6,236,709 | B1 | 5/2001 | Perry |
| 6,269,142 | B1 | 7/2001 | Smith |
| 6,324,249 | B1 | 11/2001 | Fazzio |
| 6,546,072 | B1 | 4/2003 | Chalmers |
| 6,735,271 | B1 | 5/2004 | Rand |
| 7,233,644 | B1 | 6/2007 | Bendahan |
| 7,564,939 | B2 | 7/2009 | Morton |
| 2001/0022346 | A1 | 9/2001 | Katagami |
| 2002/0031202 | A1 | 3/2002 | Callerame |
| 2002/0094064 | A1 | 7/2002 | Zhou |
| 2002/0176531 | A1 | 11/2002 | McClelland |
| 2003/0031352 | A1 | 2/2003 | Nelson |
| 2004/0120454 | A1 | 6/2004 | Ellenbogen |
| 2004/0252807 | A1 | 12/2004 | Skatter |
| 2004/0258305 | A1 | 12/2004 | Burnham |
| 2005/0031075 | A1 | 2/2005 | Hopkins |
| 2005/0053189 | A1 | 3/2005 | Gohno |
| 2005/0105682 | A1 | 5/2005 | Heumann |
| 2005/0111610 | A1 | 5/2005 | De Man |
| 2005/0157925 | A1 | 7/2005 | Lorenz |
| 2009/0316855 | A1 | 12/2009 | Morton |
| 2015/0098552 | A1* | 4/2015 | Draper ..... H05G 1/06 378/142 |
| 2017/0023696 | A1* | 1/2017 | Morton ..... G01N 23/203 |
| 2018/0075998 | A1* | 3/2018 | Raber ..... H01J 35/108 |

FOREIGN PATENT DOCUMENTS

| | | | |
|---|---|---|---|
| EP | 0531993 | A1 | 3/1993 |
| EP | 0584871 | A1 | 3/1994 |
| EP | 0924742 | A2 | 6/1999 |
| EP | 0930046 | A2 | 7/1999 |
| EP | 1277439 | A1 | 1/2003 |
| EP | 1374776 | A1 | 1/2004 |
| FR | 2328280 | A1 | 5/1977 |
| GB | 1497396 | A | 1/1978 |
| GB | 1526041 | A | 9/1978 |
| GB | 2015245 | A | 9/1979 |
| GB | 2089109 | A | 6/1982 |
| GB | 2212903 | A | 8/1989 |
| JP | S51055286 | | 5/1976 |
| JP | S52050186 | | 4/1977 |
| JP | S55046408 | | 4/1980 |
| JP | H07093525 | | 4/1995 |
| JP | H10272128 | | 10/1998 |
| JP | 2001176408 | A | 6/2001 |
| JP | 2001204723 | | 7/2001 |
| JP | 2002343291 | | 11/2002 |
| JP | 2004079128 | A | 3/2004 |
| WO | 9528715 | A2 | 10/1995 |
| WO | 9960387 | A2 | 11/1999 |
| WO | 03051201 | A2 | 6/2003 |

* cited by examiner

DEVICES AND METHODS FOR DISSIPATING HEAT FROM AN ANODE OF AN X-RAY TUBE ASSEMBLY

CROSS-REFERENCE

The present application relies on U.S. Patent Provisional Application No. 63/044,210, titled "Devices and Methods for Cooling an X-Ray Tube Assembly", filed on Jun. 25, 2020, for priority which is herein incorporated by reference in its entirety.

FIELD

The present specification is related generally to the field of X-ray tubes. More specifically, the present specification is related to a device that is used to thermally couple an anode of an X-ray tube with an air-cooled conducting container that encompasses the X-ray tube.

BACKGROUND

X-ray tubes typically include a cathode for emitting a stream of electrons and an anode which provides a metal target upon which the stream of electrons impinge thereby producing X-rays. For both low power modes and bipolar modes (where the cathode and anode are operated at different voltages), the anode is typically operated at high voltage, ranging between 60 and 90 kV. The bombardment of the electrons on the anode and the operation of the anode at such high voltages generate heat, and in an example, at least 5 Watts.

An X-ray tube is typically enclosed in a conductive enclosure and, in some cases, the region between the X-ray tube and the enclosure is filled with a thermally conductive cooling liquid (such as a cooling oil) to dissipate the heat while electrically isolating the X-ray tube from the enclosure. However, the convective heat transfer process of the oil may not be efficient enough to cool the X-ray tube down in cases where the X-ray tube is used frequently or for long periods of time. In some cases, the region between the X-ray tube and the enclosure is filled with at least one solid electrically insulating material like silicone or a mixture. Insulating materials allow improving radiation shielding and/or thermal conductivity without losing the critical electrically insulating property of the material. However, at least one common electrically insulating material has poor thermal conductivity (<1 W/(m·K)).

Accordingly, there is need for a device that improves heat dissipation from the X-ray tube. There is also a need for positioning the device such that it provides a thermal coupling between a hot anode of the X-ray tube and the enclosure containing the X-ray tube.

SUMMARY

The following embodiments and aspects thereof are described and illustrated in conjunction with systems, tools and methods, which are meant to be exemplary and illustrative, and not limiting in scope. The present application discloses numerous embodiments.

In some embodiments, the present specification discloses an X-ray source, comprising: a first enclosure defined by a first contiguous surface encompassing a first internal volume, wherein the first contiguous surface of the first enclosure comprises conducting material; a second enclosure defined by a second contiguous surface encompassing a second internal volume, wherein the second contiguous surface comprises non-conducting material, wherein the second enclosure has a first end and a second end opposing the first end, wherein the second enclosure is positioned within the first internal volume of the first enclosure, and wherein at least a portion of a region between an outer region of the second contiguous surface and the inner region of the first contiguous surface comprises a first material; a cathode positioned at the first end of the second enclosure, wherein the cathode is configured to emit electrons toward the second end of the second enclosure; an anode positioned at the second end of the second enclosure, wherein the anode comprises at least a target configured to be impinged upon by the emitted electrons; a cap positioned at the second end of the second enclosure and configured such that at least a first portion of the cap covers at least a portion of the second end of said second enclosure; and at least one heat transfer element positioned proximate the second end of the second enclosure and in said region, wherein the at least one heat transfer element comprises a first inner surface, a second outer surface opposite to said first inner surface, a third surface, and a fourth surface opposite to said third surface, wherein at least a portion of the first inner surface is in contact with at least a portion of the first portion of the cap and at least a portion of the second outer surface is in physical contact with the inner region of the first contiguous surface.

Optionally, the at least one solid heat transfer element is different from the first material.

Optionally, the at least one heat transfer element has a shape of a ring or a cylinder extending circumferentially around said cap.

Optionally, the ring or cylinder shaped at least one heat transfer element comprises a plurality of sectors coupled together and wherein each of the plurality of sectors has a polygonal cross-sectional area.

Optionally, the at least one heat transfer element substantially surrounds the second end of the second enclosure and is configured to thermally couple the anode with the first enclosure.

Optionally, the at least one heat transfer element comprises a second material and wherein the second material has a dielectric strength greater than 10 kV/mm.

Optionally, the at least one heat transfer element comprises a second material and wherein the second material has a thermal conductivity of greater than 20 W/(m·K).

Optionally, the at least one heat transfer element comprises a second material and wherein the second material has a dielectric strength greater than 10 kV/mm and a thermal conductivity of greater than 20 W/(m·K).

Optionally, the at least one heat transfer element comprises a second material and wherein the second material comprises at least one of beryllium oxide or aluminum nitride.

Optionally, the at least one heat transfer element is configured to maintain a temperature difference between the anode and the first enclosure at less than 25 Kelvin for a 100% duty cycle in thermal equilibrium.

Optionally, the at least one heat transfer element is configured to maintain a temperature difference between the anode and the first enclosure at less than 25 Kelvin for a 100% duty cycle in thermal equilibrium while not placing the anode in electrical communication with the first enclosure.

Optionally, the first material comprises electrically insulating material, and wherein a thermal conductivity of the at least one heat transfer element is at least 20 times that of the at least one electrically insulating material.

Optionally, the cap comprises a conducting material.

In some embodiments, the present specification is directed towards a portable, hand-held X-ray scanning system comprising the X-ray source described above.

In some embodiments, the present specification discloses a method of cooling an anode in an X-ray source, wherein the X-ray source comprises a first enclosed housing positioned inside a second enclosed housing and defining a space therebetween, wherein an anode is positioned at a first end of the second enclosed housing, wherein a cathode is positioned at a second opposing end of the second enclosed housing, wherein a first material is positioned in the space, and wherein a cap is positioned around the first end of the second enclosed housing proximate the anode, the method comprising: positioning at least one heat transfer element in thermal contact with the cap and extending through the space to be in thermal contact with an inner surface of the first enclosed housing, wherein the at least one heat transfer element comprises a second material different from the first material; and operating the X-ray source such that heat is dissipated from the anode, through the cap, through the at least one heat transfer element, and to the first enclosed housing.

Optionally, the at least one heat transfer element is ring-shaped or cylinder-shaped and encircles said cap.

Optionally, the at least one heat transfer element is formed as a series of sections which, in combination, create a ring or cylinder that encircles the cap and where each section of the series of sections is defined by a cross-section that may be curved or polygonal shaped.

Optionally, the at least one heat transfer element is in physical contact with an outer surface area of the cap such that a surface of the at least one heat transfer element covers 30% to 100% of the outer surface area of the cap.

Optionally, the at least one heat transfer element is in physical contact with an inner surface area of the first enclosed housing such that a surface of the at least one heat transfer element covers 2% to 50% of the inner surface area of the first enclosed housing.

Optionally, the second material has a dielectric strength greater than 10 kV/mm.

Optionally, the second material has a thermal conductivity of greater than 20 W/(m·K).

Optionally, the second material has a dielectric strength greater than 10 kV/mm and a thermal conductivity of greater than 20 W/(m·K).

Optionally, the second material comprises at least one of beryllium oxide or aluminum nitride.

Optionally, the at least one heat transfer element is configured to maintain a temperature difference between the anode and the first enclosure at less than 25 Kelvin for a 100% duty cycle in thermal equilibrium.

Optionally, the at least one heat transfer element is configured to maintain a temperature difference between the anode and the first enclosure at less than 25 Kelvin for a 100% duty cycle in thermal equilibrium while not placing the anode in electrical communication with the first enclosure.

Optionally, the first material comprises electrically insulating material, and wherein a thermal conductivity of the second material is at least 20 times that of the first material.

In some embodiments, the present specification discloses a device for cooling an anode of an X-ray source, said X-ray source having a first housing enclosed within a second housing, wherein said second housing supports said anode at a first end and a cathode at a second end, and wherein said anode has a cap positioned at said second end, said device comprising: at least one heat transfer element positioned to surround said anode and in a region between said first and second enclosures, said at least one heat transfer element having a first inner surface, a second outer surface opposite to said first inner surface, a third surface and a fourth surface opposite to said third surface, wherein at least a portion of a surface area of said first inner surface is in contact with said cap and at least a portion of a surface area of said second outer surface is in contact with said first enclosure.

Optionally, the at least one heat transfer element is configured to maintain a temperature between said anode and the conducting enclosure at less than 25 Kelvin for a 100% duty cycle in thermal equilibrium.

Optionally, at least one heat transfer element has a shape of a ring, short cylindrical, square, rectangle or an ellipse.

Optionally, the at least one heat transfer element has one of a square, rectangular, trapezoidal, circular, or oval cross-sectional shape.

Optionally, the at least one heat transfer element is positioned proximate said anode and thermally couples said anode with said second enclosure.

Optionally, the at least one heat transfer element has dielectric strength of greater than 10 kV/mm and thermal conductivity of greater than 20 W/(m·K).

Optionally, a region between said first and second enclosures is filled with at least one electrically insulating material, and wherein a thermal conductivity of said at least one heat transfer element is at least 20 times that of said at least one electrically insulating material.

Optionally, the cap is of an X-ray shielding material.

Optionally, the first enclosure is of non-conducting material and said second enclosure is of conducting material.

Optionally, the second housing is supported within a portable, hand-held X-ray scanning system.

The aforementioned and other embodiments of the present shall be described in greater depth in the drawings and detailed description provided below.

BRIEF DESCRIPTION OF THE DRAWINGS

These and other features and advantages of the present specification will be further appreciated, as they become better understood by reference to the following detailed description when considered in connection with the accompanying drawings.

DETAILED DESCRIPTION

The present specification is directed towards multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

In the description and claims of the application, each of the words "comprise" "include" and "have", and forms thereof, are not necessarily limited to members in a list with which the words may be associated. It should be noted herein that any feature or component described in association with a specific embodiment may be used and implemented with any other embodiment unless clearly indicated otherwise.

As used herein, the indefinite articles "a" and "an" mean "at least one" or "one or more" unless the context clearly dictates otherwise.

Figure 1:
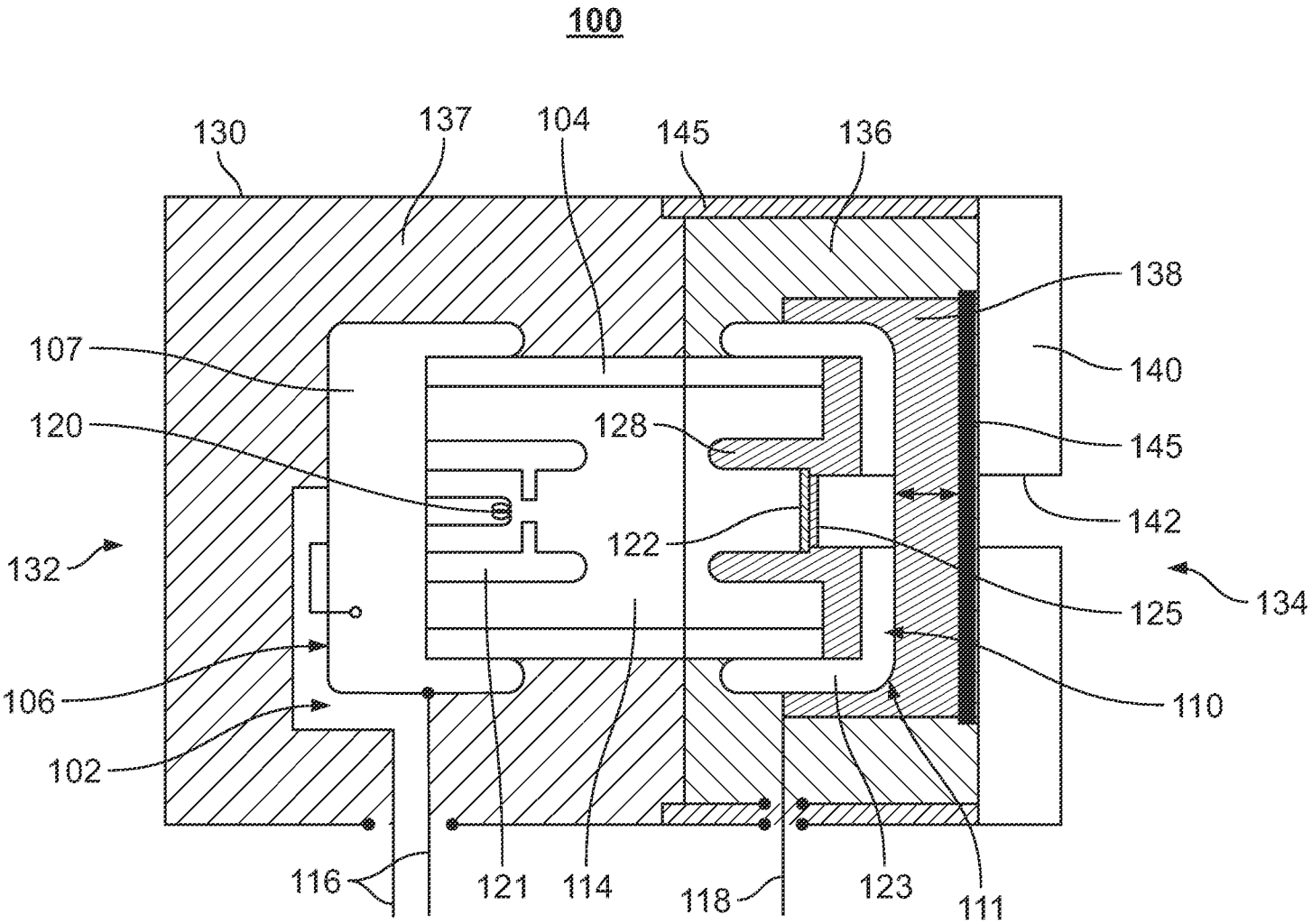
FIG. 1 (PRIOR ART)
FIG. 1 is a schematic cross-sectional view of a prior art X-ray source without an efficient cooling mechanism, for which continuous operation will lead to overheating and failure.

FIG. 1 is a schematic cross-sectional view of a prior art X-ray source 100 over which embodiments of the present specification represent improvements. The source 100 comprises an X-ray tube assembly 102 having a non-conducting hollow housing 104 with a first end 107 and a second end 111. A cathode assembly 106 and an anode assembly 110 are mounted to the housing 104 at the first and second ends 107, 111 respectively. Cables 116 electrically couple the cathode assembly 106 with a negative terminal of a high voltage power supply while cable 118 electrically couples the anode assembly 110 to a positive terminal of the high voltage power supply.

The cathode assembly 106 includes an electron beam generator or emitter 120 and one or more focus electrodes 121 to shape an electron beam, extracted from the generator 120, as it passes into the high electric field region 114 between the one or more focus electrodes 121 and an X-ray producing target 122 of the anode assembly 110. The electron beam generator or emitter 120 is a tungsten filament emitter known to persons of ordinary skill in the art.

The region 114 within the housing 104 is maintained at a vacuum sufficient to allow electrons to flow substantially unobstructed between the cathode assembly 106 and the anode assembly 110. The housing 104 is a cylindrical tube made from vacuum-compatible high voltage non-conducting material known to persons of ordinary skill in the art. The housing 104 includes at least one opening 125 that is X-ray transmissive.

The anode assembly 110 includes the X-ray producing target 122 applied to the vacuum side of the window 125. The anode assembly 110 also includes a cylindrical electrode 128 that stops or inhibits electrons that may backscatter from the target 122 along with a tungsten shielding cap 123 positioned at and covering the second end 111. In some embodiments, a portion of the cap 123 extends over a portion of the non-conducting hollow housing 104. During operation, electrons emitted from the generator 120 impinge upon the target 122 to produce X-rays that emanate through the window 125. In some embodiments, the X-ray producing target 122 is formed from materials such as gold or tungsten.

The X-ray tube assembly 102 is positioned within an enclosure 130 having a first end 132 and a second end 134. In embodiments, the enclosure 130 is formed of a conducting material such as aluminum and is held at ground potential. The volume of regions 136, 137 between the enclosure 130 and the X-ray tube assembly 102 is filled with electrically non-conducting materials which may be solid, liquid or gaseous. The volume of region 138 surrounding the window 125 may be filled with X-ray transparent, electrically non-conducting material.

A plate 140 of tungsten is positioned covering the second end 134 such that an opening 142 in the plate 140 aligns with the window 125. Additionally, a layer 145 is positioned within the enclosure 130 and abutting the plate 140 such that the layer 145 covers the opening 142. In embodiments, the layer 145 is of an electrically conducting material and may be electrically coupled to the plate 140 to lower electric field in the opening 142. A radio-opaque casing 145 is positioned within and in contact with the enclosure 130 and towards the second end 111 thereby lying proximate the anode assembly 110.

The prior art X-ray source 100, however, has a shortcoming in that the X-ray tube assembly 102 and, more specifically, the anode assembly 110 is prone to overheating during generation of X-rays, which leads to subsequent failure. Thermal conductivity between the anode assembly 110 and the air-cooled enclosure 130 (along with the plate 140 and the casing 145) is low since the electrically non-conducting materials of regions 136, 137 and 138 have high thermal resistance. For example, regions 136 and 137 when filled with a mixture of $Bi_2O_3$ and silicone has poor heat conductivity of, typically, <1 W/(m·K) while the insulator of region 138 is an even poorer conductor of heat.

For extended use periods, this causes a large thermal gradient between the anode assembly 110 and the enclosure 130, and, unfortunately, limits the usable average beam power for extended periods, thereby limiting the performance of the X-ray tube assembly 102. Consequently, the X-ray tube assembly 102 may be used only at a fraction, such as 50% or less, of its designed beam power which, in some embodiments, may be about 10 Watts. This is typically achieved by limiting the duty cycle, for instance, by turning the X-ray beam off for 15 seconds after 15 seconds of beam time.

Figure 2:
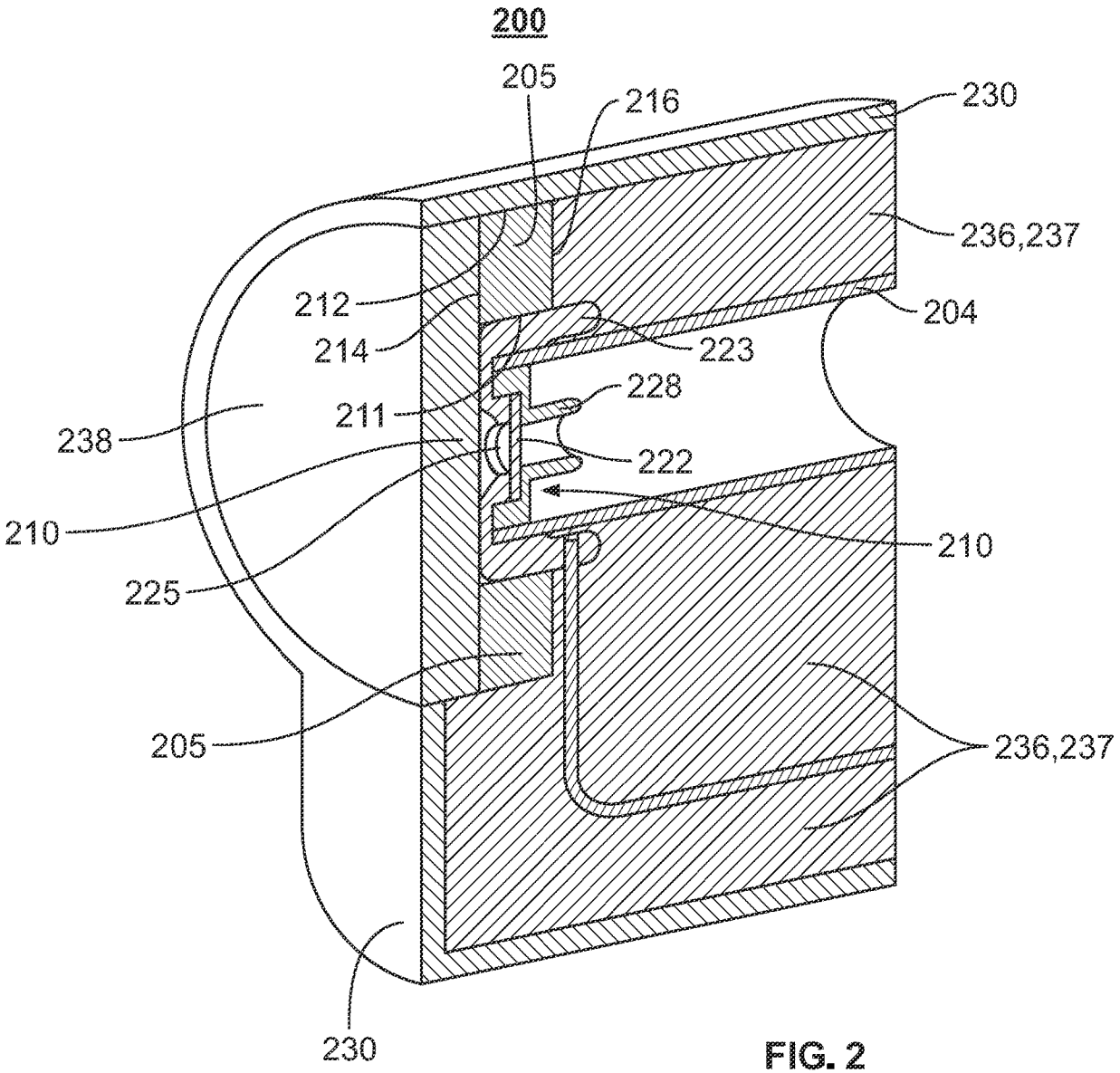
FIG. 2 is a perspective cross-sectional view of an X-ray source with an efficient cooling mechanism, in accordance with an embodiment of the present specification.

FIG. 2 is a perspective cross-sectional view of an improved anode assembly 200 which may be implemented in an X-ray source, in accordance with an embodiment of the present specification. As seen in FIG. 2, the anode assembly 200 includes an X-ray producing target 222 applied, deposited, or positioned onto the vacuum side of the X-ray transmissive window 225. The vacuum side may also be referred to as the second end of the of the non-conducting hollow housing, enclosure, or tube 204, where the first end, opposite to the second end, houses the cathode. The anode assembly 200 also includes a substantially cylindrical electrode 228 that stops or inhibits electrons that may backscatter from the target 222. The anode assembly 200 is supported within the non-conducting hollow housing, enclosure, or tube 204. FIG. 2 also shows a tungsten shielding cap 223 with a portion of the cap 223 extending over or around a peripheral portion of the second end of the non-conducting hollow housing, enclosure, or tube 204.

The conducting enclosure 230 encompasses the housing or tube or enclosure 204 along with volumes or regions 236, 237 that are filled with electrically insulating material. FIG. 2 further shows the volume or region 238, covering the window 225, filled with X-ray transparent, electrically non-conducting material such as, for example, Ultem.

In accordance with an aspect of the present specification, at least one heat transfer element 205 is positioned within the anode assembly 200 proximate the cap 223, such that it is thermally coupled with the cap 223 and extends outward to the conducting enclosure 230. In embodiments, the at least one heat transfer element 205 occupies a portion of the region between the non-conducting tube 204 and the conducting enclosure 230. The at least one heat transfer element 205 is thus positioned to thermally couple the anode 210 (which is at a high voltage, typically between 60 and 90 kV) and typically hot to the air-cooled conducting enclosure 230 (which is at ground potential) while maintaining an electric isolation.

In various embodiments, the at least one heat transfer element 205 is shaped in the form of a ring, short cylinder, or sectors thereof with a suitable cross-sectional shape such as, for example, square, rectangular, polygon, trapezoidal, or any other shape with sufficient inner and outer thermal contact area to maintain a temperature difference between the anode 210 and the conducting enclosure 230 at less than 25 Kelvin for a 100% duty cycle in thermal equilibrium. In some embodiments, more than one heat transfer element 205 may be employed. For example, a ring or a short cylinder-shaped single heat transfer element may be replaced with a plurality of ring or short cylinder sectors (such as those generated by radially segmenting a ring or a short cylinder).

As previously stated, the at least one heat transfer element is configured to maintain a temperature difference between the anode 210 and the conducting enclosure 230 at less than 25 Kelvin for a 100% duty cycle in thermal equilibrium while still maintaining electrical isolation between the anode 130 and conducting enclosure 230. In an embodiment, a 100% duty cycle in thermal equilibrium refers to the X-rays being constantly on for an unlimited time period.

FIG. 2 illustrates an embodiment of the at least one heat transfer element 205 shaped in the form of a ring with a rectangular cross-section having a first inner surface 211, a second outer surface 212 (opposite to the first inner surface 211), a third surface 214 and a fourth surface 216 (opposite to the third side surface 214). The third and fourth surfaces 214, 216 extend between the first inner surface 211 and the second outer surface 212.

In some embodiments, the at least one heat transfer element 205 substantially surrounds the anode 210 such that at least a portion of the first inner surface 211 touches and therefore is thermally coupled to a portion of the X-ray shielding cap 223. In another embodiment, the at least one heat transfer element 205 substantially surrounds the tube encasing the anode 210 and there is no intervening cap. In embodiments, the portion of the X-ray shielding cap 223 to which the first inner surface 211 is thermally coupled, is the portion of the cap 223 extending over a portion of the second end of the non-conducting hollow housing, enclosure, or tube 204. At least a portion of the second outer surface 212 touches and therefore is thermally coupled to an inner surface of the air-cooled conducting enclosure 230. Consequently, the at least one heat transfer element 205 enables and improves conductive heat transfer from the X-ray shielding cap 223 and therefore from the anode assembly 210, which is typically hot, to the air-cooled conducting enclosure 230.

In some embodiments, at least a portion of an outer surface of the enclosure 230 includes a plurality of outward extending radial fins or protrusions to enhance convective heat transfer from the enclosure 230. In embodiments, the plurality of fins or protrusions is of conductive material that may or may not be the same material as that of the enclosure 230.

In some embodiments, at least a portion of the surface area of the first inner surface 211 is in physical contact with the X-ray shielding cap 223. In some embodiments, at least a portion of the surface area of the second outer surface 212 is in physical contact with the conducting enclosure 230. In some embodiments, a range of 30% to 100%, preferably at least 50% or any numerical increment therein, of the surface area of the first inner surface 211 is in physical contact with the X-ray shielding cap 223. In some embodiments, a range of 30% to 100%, preferably at least 50% or any numerical increment therein, of the surface area of the second outer surface 212 is in physical contact with the conducting enclosure 230. It should be appreciated that, in a preferred embodiment, the at least one heat transfer element 205 is formed as a series of sections which, in combination, create a ring that encircles the cap 223 (such that the inner surface 211 is in contact, as described above, with the cap 223) and which, in turn, is encircled by the conducting enclosure 230 (such that the outer surface 212 is in contact, as described above, with the enclosure 230) and where each section has a cross-section that may be curved or polygonal shaped.

In some embodiments, a range of 20% to 100%, preferably at least 50% or any numerical increment therein, of the outer surface area of the shielding cap 223 that is positioned parallel to the length of the tube 204 is in physical contact with the first inner surface 211. In some embodiments, a range of 2% to 50%, preferably at least 5% of the surface area of the conducting enclosure 230 is in physical contact with the second outer surface 212.

In some embodiments, the at least one heat transfer element 205 is configured to maintain a temperature difference between the anode 210 and the conducting enclosure 230 at less than 25 Kelvin for a 100% duty cycle in thermal equilibrium. In an embodiment, a 100% duty cycle in thermal equilibrium refers to the X-rays being constantly on for an unlimited time period.

In embodiments, a thermal conductivity of the at least one heat transfer element 205 is at least 20 times that of the electrically insulating material(s) in the regions 236, 237 and 238. It should be appreciated that there is a 60 to 90 kV potential difference between anode 210 and the grounded enclosure 230 and if not designed properly, there will be arcing which will could destroy the X-ray source. Therefore, only materials with high dielectric strength can be used for the at least one heat transfer element 205. In some embodiments, the at least one heat transfer element 205 is of a material having high dielectric strength in a range that is greater than 10 kV/mm and good thermal conductivity in a range that is greater than >20 W/(m·K). Such materials include, but are not limited to, beryllium oxide (BeO) and aluminum nitride (AlN)—both of which have thermal conductivities >100 W/(m·K).

Figure 3A:
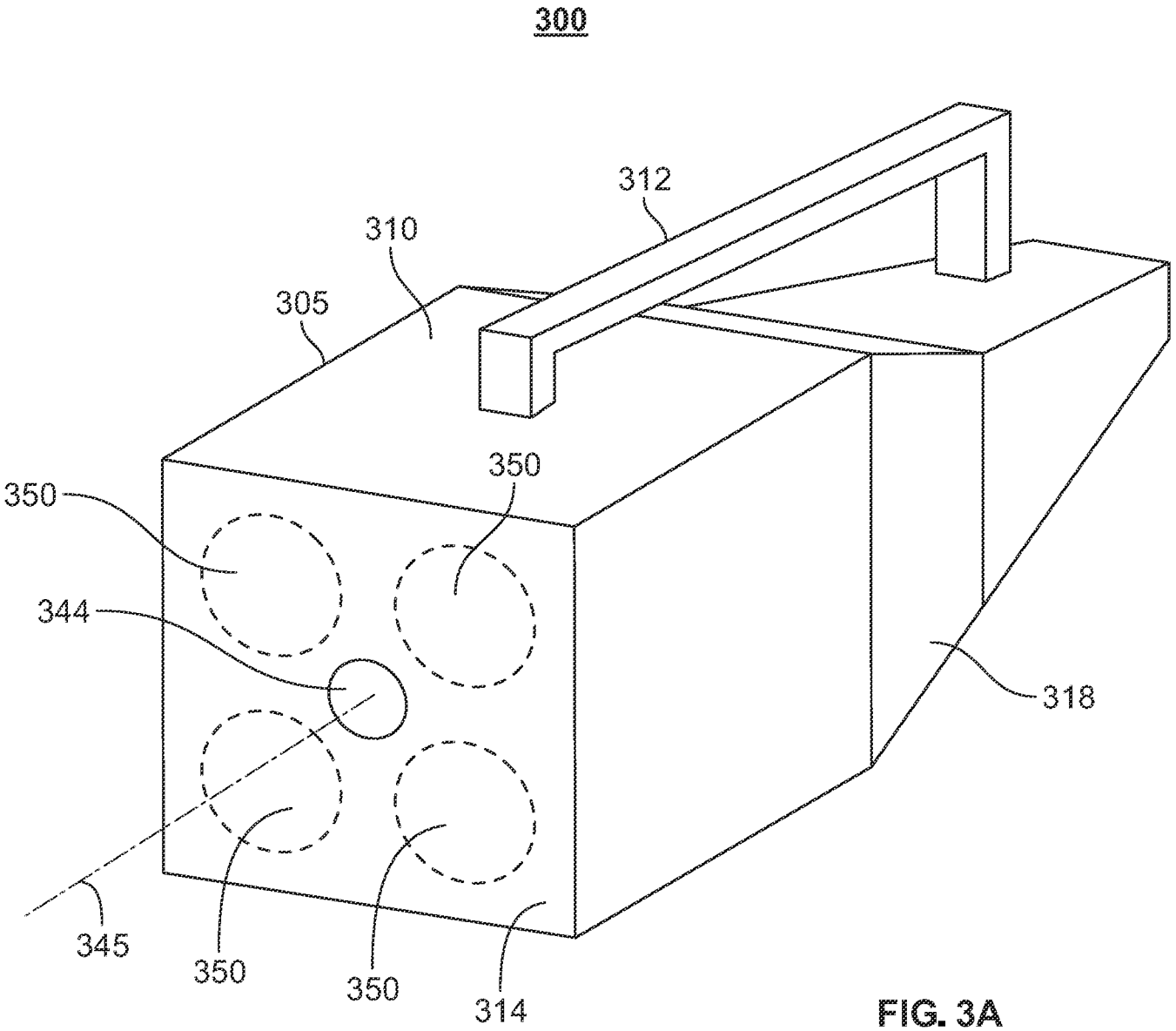
FIG. 3A is a perspective view of an embodiment of a portable, hand-held X-ray scanning system.

FIG. 3A is a perspective view of an embodiment of a portable, hand-held X-ray scanning system 300. The system 300 is used to screen objects such as, but not limited to, baggage and containers/boxes for threat materials, items or people concealed therein. In an embodiment, the system 300 has a housing 305 having an upper surface 310, a base (not visible in FIG. 3A, but opposite, and substantially parallel to, the upper surface 310), a front surface 314, a rear surface (not visible in FIG. 3A, but opposite, and parallel to, the front surface 314), a first side 318, and a second side (not visible in FIG. 1A, but opposite, and parallel to, the first side 318).

It should be appreciated that the shape of the housing 305 can be cuboidal, cylindrical, conical, pyramidal or any other suitable shape as would be evident to persons of ordinary skill in the art. The size and weight of the system 300 is optimized for enabling an operator to conveniently hold and maneuver the housing 305 while scanning an object under inspection. At least one handle 312 is provided on, for example, the upper surface 310 to allow the operator to hold the housing 305 conveniently in one or both hands and manipulate the device 300 to point the front surface 314 towards and at different regions on the object under inspection.

Figure 3B:
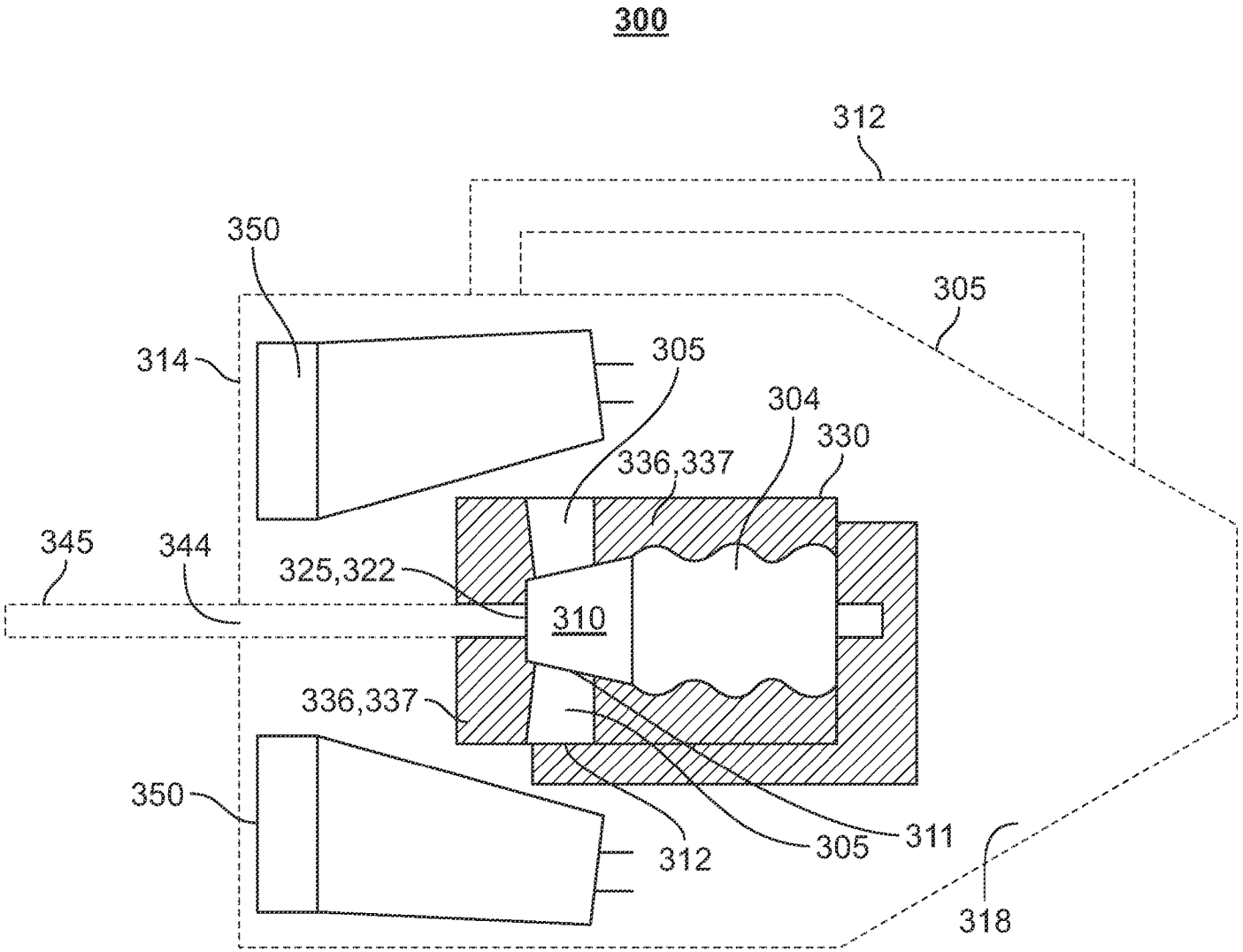
FIG. 3B is a vertical cross-sectional view of the portable, hand-held X-ray scanning system of FIG. 3A.

FIG. 3B is a vertical cross-sectional view of the system 300. Referring now to FIGS. 3A and 3B, the system enclosure 305 comprises the conducting enclosure 330 of the X-ray tube 304 of FIG. 2. Also visible is the window 325 with target 322 of the anode 310 that emits a spatially localized X-ray beam 345 through the collimator 344. Also shown is the at least one heat transfer element 305 that thermally couples the anode 310 to the enclosure 330. The first inner surface 311 is in contact with the anode assembly 310 while the second outer surface 312 is in contact with the enclosure 330. In some embodiments, the window 325 is configured as a collimator to form the X-ray radiation emitted from the anode assembly 310 into a shaped beam of X-rays 345. In various embodiments, the X-ray beam 345 is shaped into a pencil beam, a cone beam, a fan beam, a single-axis rotating beam or a dual-axis rotating beam. Note that, in FIG. 3B, a cathode assembly has not been made explicit for clarity purposes.

In accordance with an embodiment, the shaped X-ray beam 345 emerges through an opening 344 at the center of the front surface 314 of the housing 305, in a direction substantially perpendicular to the front surface 314. At least one or a plurality of X-ray backscatter detectors 350, also referred to as sensors, are positioned adjacent to and behind front surface 314 such that they surround the area or region of emergence of X-ray beam 345 at opening 344 and cover a substantial area of front surface 314 in order to maximize detected backscatter signal. An embodiment of the present specification comprises four sets of detectors 350. In other embodiments, a different number of detectors 350 may be utilized.

During operation, the shaped X-ray beam 345 interacts with an object under inspection, to produce scattered X-rays that are detected by the detectors 350 to produce scan data signal.

The above examples are merely illustrative of the many applications of the system and method of present specification. Although only a few embodiments of the present specification have been described herein, it should be understood that the present specification might be embodied in many other specific forms without departing from the spirit or scope of the specification. Therefore, the present examples and embodiments are to be considered as illustrative and not restrictive, and the specification may be modified within the scope of the appended claims.

I claim:

1. An X-ray source, comprising:

a first enclosure defined by a first contiguous surface encompassing a first internal volume, wherein the first contiguous surface of the first enclosure comprises conducting material;

a second enclosure defined by a second contiguous surface encompassing a second internal volume, wherein the second contiguous surface comprises non-conducting material, wherein the second enclosure has a first end and a second end opposing the first end, wherein the second enclosure is positioned within the first internal volume of the first enclosure, and wherein at least a portion of a region between an outer region of the second contiguous surface and the inner region of the first contiguous surface comprises a first material;

a cathode positioned at the first end of the second enclosure, wherein the cathode is configured to emit electrons toward the second end of the second enclosure;

an anode positioned at the second end of the second enclosure, wherein the anode comprises at least a target configured to be impinged upon by the emitted electrons;

a cap positioned at the second end of the second enclosure and configured such that at least a first portion of the cap covers at least a portion of the second end of said second enclosure; and at least one heat transfer element positioned proximate the second end of the second enclosure and in said region, wherein the at least one heat transfer element comprises a first inner surface, a second outer surface opposite to said first inner surface, a third surface, and a fourth surface opposite to said third surface, wherein at least a portion of the first inner surface is in contact with at least a portion of the first portion of the cap and at least a portion of the second outer surface is in physical contact with the inner region of the first contiguous surface;

wherein the second enclosure, cathode, anode, cap, and the at least one heat transfer element are positioned within the first internal volume such that they are positioned inside the first contiguous surface.

2. The X-ray source of claim 1, wherein the at least one solid heat transfer element is different from the first material.

3. The X-ray source of claim 1, wherein the at least one heat transfer element has a shape of a ring or a cylinder extending circumferentially around said cap.

4. The X-ray source of claim 3, wherein the ring or cylinder shaped at least one heat transfer element comprises a plurality of sectors coupled together and wherein each of the plurality of sectors has a polygonal cross-sectional area.

5. The X-ray source of claim 1, wherein the at least one heat transfer element substantially surrounds the second end of the second enclosure and is configured to thermally couple the anode with the first enclosure.

6. The X-ray source of claim 1, wherein the at least one heat transfer element comprises a second material and wherein the second material has a dielectric strength greater than 10 kV/mm.

7. The X-ray source of claim 1, wherein the at least one heat transfer element comprises a second material and wherein the second material has a thermal conductivity of greater than 20 W/(m·K).

8. The X-ray source of claim 1, wherein the at least one heat transfer element comprises a second material and wherein the second material has a dielectric strength greater than 10 kV/mm and a thermal conductivity of greater than 20 W/(m·K).

9. The X-ray source of claim 1, wherein said at least one heat transfer element comprises a second material and wherein the second material comprises at least one of beryllium oxide or aluminum nitride.

10. The X-ray source of claim 1, wherein said at least one heat transfer element is configured to maintain a temperature difference between the anode and the first enclosure at less than 25 Kelvin for a 100% duty cycle in thermal equilibrium.

11. The X-ray source of claim 1, wherein said at least one heat transfer element is configured to maintain a temperature difference between the anode and the first enclosure at less than 25 Kelvin for a 100% duty cycle in thermal equilibrium while not placing the anode in electrical communication with the first enclosure.

12. The X-ray source of claim 1, wherein the first material comprises electrically insulating material, and wherein a thermal conductivity of the at least one heat transfer element is at least 20 times that of the at least one electrically insulating material.

13. The X-ray source of claim 1, wherein the cap comprises a conducting material.

14. A portable, hand-held X-ray scanning system comprising the X-ray source of claim 1.

15. A method of cooling an anode in an X-ray source, wherein the X-ray source comprises a second enclosed housing positioned inside a first enclosed housing and defining a space therebetween, wherein an anode is positioned at a first end of the second enclosed housing, wherein a cathode is positioned at a second opposing end of the second enclosed housing, wherein a first material is positioned in the space, and wherein a cap is positioned around the first end of the second enclosed housing proximate the anode, the method comprising:

positioning at least one heat transfer element in thermal contact with the cap and extending through the space to be in thermal contact with an inner surface of the first enclosed housing, wherein the at least one heat transfer element comprises a second material different from the first material; and operating the X-ray source such that heat is dissipated from the anode, through the cap, through the at least one heat transfer element, and to the first enclosed housing;

wherein the second enclosed housing, cathode, anode, cap, and the at least one heat transfer element are positioned within the space therebetween.

16. The method of claim 15, wherein the at least one heat transfer element is ring-shaped or cylinder-shaped and encircles said cap.

17. The method of claim 15, wherein the at least one heat transfer element is formed as a series of sections which, in combination, create a ring or cylinder that encircles the cap and where each section of the series of sections is defined by a cross-section that is curved or polygonal shaped.

18. The method of claim 15, wherein the at least one heat transfer element is in physical contact with an outer surface area of the cap such that a surface of the at least one heat transfer element covers 30% to 100% of the outer surface area of the cap.

19. The method of claim 15, wherein the at least one heat transfer element is in physical contact with an inner surface area of the first enclosed housing such that a surface of the at least one heat transfer element covers 2% to 50% of the inner surface area of the first enclosed housing.

20. The method of claim 15, wherein the second material has a dielectric strength greater than 10 kV/mm.

21. The method of claim 15, wherein the second material has a thermal conductivity of greater than 20 W/(m·K).

22. The method of claim 15, wherein the second material has a dielectric strength greater than 10 kV/mm and a thermal conductivity of greater than 20 W/(·mK).

23. The method of claim 15, wherein the second material comprises at least one of beryllium oxide or aluminum nitride.

24. The method of claim 15, wherein the at least one heat transfer element is configured to maintain a temperature difference between the anode and the first enclosed housing at less than 25 Kelvin for a 100% duty cycle in thermal equilibrium.

25. The method of claim 15, wherein the at least one heat transfer element is configured to maintain a temperature difference between the anode and the first enclosed housing at less than 25 Kelvin for a 100% duty cycle in thermal equilibrium while not placing the anode in electrical communication with the first enclosed housing.

26. The method of claim 15, wherein the first material comprises electrically insulating material, and wherein a thermal conductivity of the second material is at least 20 times that of the first material.

* * * * *